US006414290B1

(12) United States Patent
Cole et al.

(10) Patent No.: US 6,414,290 B1
(45) Date of Patent: Jul. 2, 2002

(54) PATTERNED MICROWAVE SUSCEPTOR

(75) Inventors: Lorin R. Cole, Batavia; Terrence P. Lafferty, Milford, both of OH (US)

(73) Assignee: Graphic Packaging Corporation, Golden, CO (US)

( * ) Notice: Subject to any disclaimer, the term of this patent is extended or adjusted under 35 U.S.C. 154(b) by 0 days.

(21) Appl. No.: 09/044,576

(22) Filed: Mar. 19, 1998

(51) Int. Cl.[7] ..... H05B 6/80
(52) U.S. Cl. ..... 219/759; 219/730
(58) Field of Search ..... 219/730–735, 219/728, 759; 426/107, 109, 234, 241, 243; 99/DIG. 14

(56) References Cited

U.S. PATENT DOCUMENTS

| | | | | | |
|---|---|---|---|---|---|
| 4,398,994 | A | * | 8/1983 | Beckett | 156/659.1 |
| 4,552,614 | A | * | 11/1985 | Beckett | 156/640 |
| 4,883,936 | A | | 11/1989 | Maynard et al. | 219/10.55 F |
| 4,896,009 | A | | 1/1990 | Pawloski | 219/10.55 E |
| 4,927,991 | A | * | 5/1990 | Wendt et al. | 219/730 |
| 5,038,009 | A | * | 8/1991 | Babbitt | 219/730 |
| 5,079,397 | A | | 1/1992 | Keefer | 291/10.55 |
| 5,213,902 | A | | 5/1993 | Beckett | 428/597 |
| 5,220,143 | A | | 6/1993 | Kemske et al. | 219/10.55 E |
| 5,239,153 | A | | 8/1993 | Beckett | 219/10.55 |
| 5,278,378 | A | | 1/1994 | Beckett | 219/728 |
| 5,391,864 | A | * | 2/1995 | Bodor et al. | 219/730 |
| 5,466,917 | A | * | 11/1995 | Matsuki et al. | 219/730 |
| 5,585,027 | A | * | 12/1996 | Young et al. | 219/730 |
| 6,133,560 | A | * | 10/2000 | Zeng et al. | 219/730 |

FOREIGN PATENT DOCUMENTS

| | | |
|---|---|---|
| WO | WO 93/09945 | 5/1993 |
| WO | WO 98/35887 | 8/1998 |

* cited by examiner

*Primary Examiner*—Tu Ba Hoang
(74) *Attorney, Agent, or Firm*—Dorsey & Whitney LLP

(57) ABSTRACT

The heating effect of a microwave susceptor can be improved by providing a pattern of microwave transparent areas in the susceptor. The transparent areas are preferably circles having a diameter of about 0.5 inch. The distance between adjacent circles is preferably about 0.5 inch. The susceptor may be used to brown and crispen the crust of frozen pizza heated in a microwave oven. The crust of the pizza is browner, especially at its central area, than the crust of pizza heated using a conventional susceptor.

14 Claims, 3 Drawing Sheets

PATTERNED MICROWAVE SUSCEPTOR

This invention is a microwave susceptor having a pattern of microwave transparent areas that enhances the heating effect of the susceptor at its center.

BACKGROUND OF THE INVENTION

A microwave susceptor typically comprises a layer of metallized plastic film laminated to a dimensionally stable substrate, such as paperboard. The thickness of the metal is such that the metal absorbs microwave energy and converts it into heat. Such susceptors are commonly used commercially to brown and crispen food in contact with the susceptor. One example of such use is in connection with frozen, packaged pizza having a diameter of about 7 inches (about 18 cm). The susceptor, which is placed under the pizza, browns and crispens the crust of the pizza. However, it has been found that a conventional susceptor does not brown or crispen the center of the pizza satisfactorily when the pizza has a diameter from about 8 to 12 inches (about 20 to 30 cm). U.S. Pat. No. 4,896,009 to Pawlowski discloses that the browning and crisping effect of a susceptor used with pizzas having diameters between 7 and 12 inches can be improved by providing one or more apertures at the center of the susceptor. According to Pawlowski, the improvement is due to the escape of vapor through the apertures, which allows the pizza to remain in contact with the susceptor. However, providing apertures in the susceptor requires a separate step in the manufacture of the susceptor and produces chad that must be disposed of. It also destroys the integrity of the susceptor, which forms part of the package for the pizza.

This invention provides a susceptor that produces results at least as good as the results produced by the susceptor in Pawlowski by providing a pattern of microwave transparent areas in the susceptor. U.S. Pat. Nos. 4,883,936 and 5,220,143 disclose that the heating effect of a susceptor can be reduced in selected areas by providing a pattern of microwave transparent areas in the susceptor, but the object of this invention is to increase, not reduce, the heating effect of the susceptor. U.S. Pat. No. 5,530,231 discloses that the heating effect of a susceptor can be increased by providing a pattern of microwave transparent areas in the susceptor, but the patent fails to teach the pattern of this invention, which produces superior results.

SUMMARY OF THE INVENTION

This invention is an improvement in the typical microwave susceptor comprising a layer of metallized plastic film laminated to a dimensionally stable substrate, such as paper or paperboard. The susceptor of this invention has a pattern of substantially microwave transparent areas in the layer of metal on the plastic film that enhances the heating effect of the susceptor in the central area of the susceptor.

Each transparent area is circumscribed, i.e., it is a closed geometrical figure. Therefore, the susceptor in which the pattern is formed is electrically continuous. The geometrical figure can be a polygon, such as a triangle, rectangle or hexagon, a circle or elipse, a cross or a star. The geometrical figure preferably has an aspect ratio of from about 1 to 1 to 2 to 1. Accordingly, if the figure is a polygon, it is preferably a regular polygon, such as a square. The figure is most preferably a circle.

The major linear dimension of the transparent area is between about 0.6 and 2.5 cm. For example, if the area is a circle, the diameter of the circle is from about 0.6 to 2.5 cm, and ideally is about 1.3 cm (about 0.5 inch), which happens to be about ⅛ of the wavelength of microwaves in a conventional microwave oven. When the transparent area is a circle and the susceptor is used to brown the crust of a frozen pizza in a microwave oven, a brown annular ring forms on the pizza around the circle. The thickness of the annular ring (distance from the edge of the circle to the edge of the browning) is about 0.13 inch (about 0.33 cm). When the diameter of the circle is more than about 0.5 inch (about 1.3 cm), the thickness of the annular ring is about the same, but the area within the annular ring, which is not browned, is larger, so it is not desirable to increase the diameter of the circle substantially above about 0.5 inch (1.3 cm). When the diameter of the circle is less than about 0.5 inch (1.3 cm), less browning around the edge of the circle is observed, e.g., the thickness of the annular ring is less, so it is not desirable to decrease the diameter of the circle to less than about 0.5 inch (1.3 cm).

The distance between adjacent transparent areas is preferably between about one and three cm.

The transparent area can be formed in several different ways. As described in U.S. Pat. No. 5,530,231, a pattern of oil can be deposited on the plastic film before the metal is deposited on the film to prevent the deposition of metal on the film in the areas masked by the oil. Alternatively, an etchant, such as caustic solution, can be applied to a metallized plastic film to dissolve and wash away the metal to form the desired transparent areas. The preferred technique, which is described in U.S. Pat. No. 4,865,921, is to apply a chemical, such as sodium hydroxide, to inactivate the metal, without removing it, in a pattern to form the desired transparent areas. Transparent areas can also be formed by cutting holes in the susceptor, as taught in the Pawlowski patent referred to above, but since such structures are in the prior art, this invention is limited to susceptors that are imperforate.

The transparent areas are preferably concentrated at the center of the susceptor since that is where improved browning is desired. Fewer transparent areas are needed as the distance from the center of the susceptor increases. In the area within a radius of about two inches (about five cm) from the center, the proportion of the area of the transparent areas to that central area of the susceptor (about 80 sq. cm) is preferably from about 10 to 20%. In the annular ring that extends from about two inches (about five cm) to about four inches (about ten cm) from the center of the susceptor, the proportion of the area of the transparent areas to the total area of the susceptor is preferably from about 5 to 15%. The proportion of the area of the transparent areas to the total area of the entire susceptor is preferably from about 7 to 15%.

DETAILED DESCRIPTION OF A PREFERRED EMBODIMENT

Figure 1:
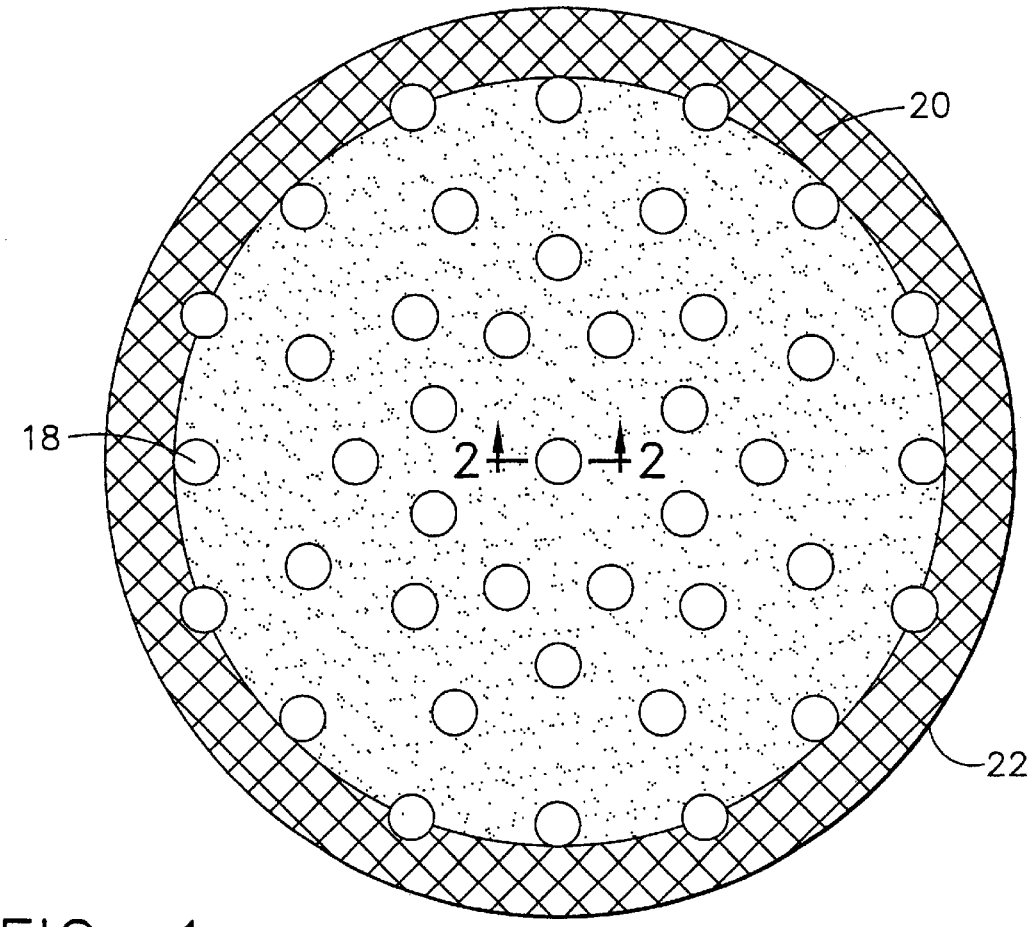
FIG. 1 is a top view of the preferred embodiment of the improved microwave susceptor of this invention.
Figure 2:
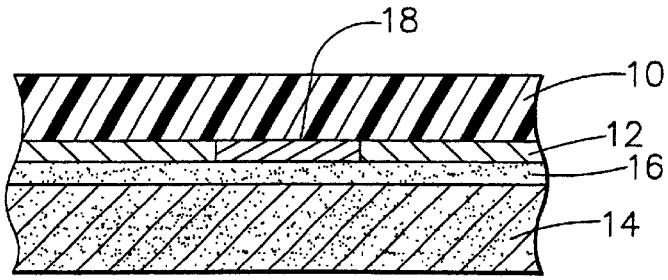
FIG. 2 is a partial cross sectional view of the susceptor shown in FIG. 1 taken along line 2—2.

As shown in FIGS. 1 and 2, a preferred embodiment of the improved susceptor comprises a layer of plastic film 10 on which is deposited, such as by vacuum deposition, a layer of metal 12, preferably aluminum. The thickness of the metal is such that it absorbs microwave radiation and converts the microwave energy into heat. The plastic film is preferably made from polyethylene terephthalate and preferably has a thickness of about 0.48 mil (about 12 microns). The metallized film is laminated to a layer of paperboard 14 using a conventional adhesive 16.

A pattern of forty-one circles 18 was formed in the metallized film by applying a chemical, such as sodium hydroxide, to inactivate the metal in each circle. The inactivated metal is substantially transparent to microwave radiation. The diameter of each circle was about 0.50 inch (about 1.3 cm). The inactivating chemical was also used to form a grid pattern 20 in the annular peripheral margin 22 of the susceptor. The width of the peripheral margin 22 was about 0.75 inch (about 1.9 cm). The overall width of the susceptor was 10.5 inches (about 27 cm) to accommodate a pizza of about the same size (not shown) which is placed on top of the susceptor. The metal layer 12, which is visible as a gray substrate beneath the clear plastic film 10, is indicated by stippling in FIG. 1. The inactivated metal appears white.

Figure 3:
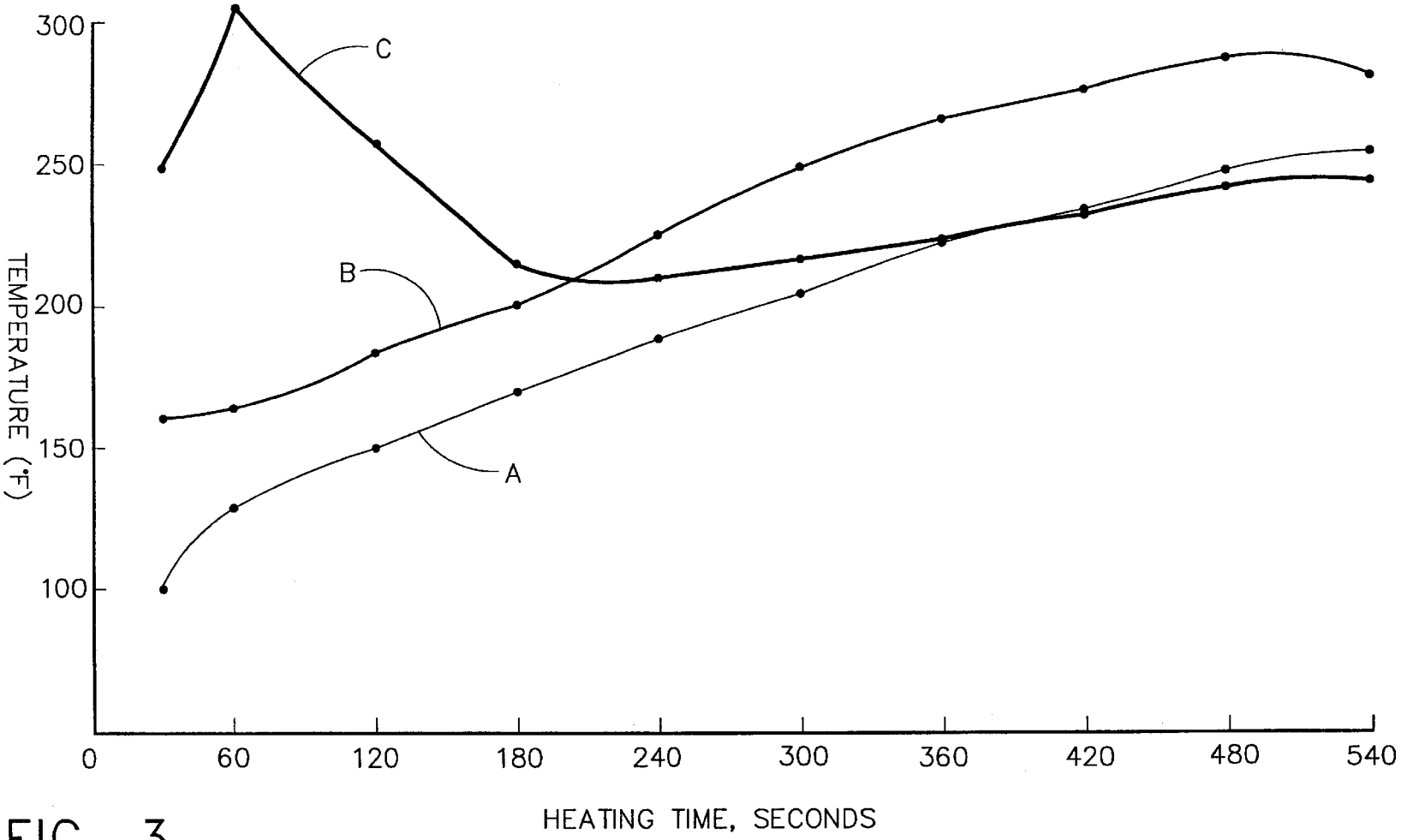
FIG. 3 is a graph of the surface temperature of the central area of the crust of a pizza heated in a microwave oven using the susceptor shown in FIG. 1 compared to the surface temperature of the central area of the crust of a pizza heated in a microwave oven using a conventional susceptor.

A commercially available, frozen pizza conforming to the susceptor was placed on top of the susceptor and heated in a microwave oven. Luxtron™ temperature probes were placed between the pizza and the susceptor in the circle at the center of the susceptor and around the circle. This experiment was repeated using a conventional susceptor, i.e., a susceptor in which the metal layer covered the entire surface of the susceptor. The results are shown in FIG. 3, where line A represents the average temperatures recorded by the probes in contact with the circle, line B represents the average temperatures recorded by the probes in contact with the area around the circle, and line C represents the average temperature recorded by comparably placed probes using the conventional susceptor. As can be seen from FIG. 3, the susceptor of this invention produces a higher final temperature in the central area of the pizza than a conventional susceptor.

Figure 4:
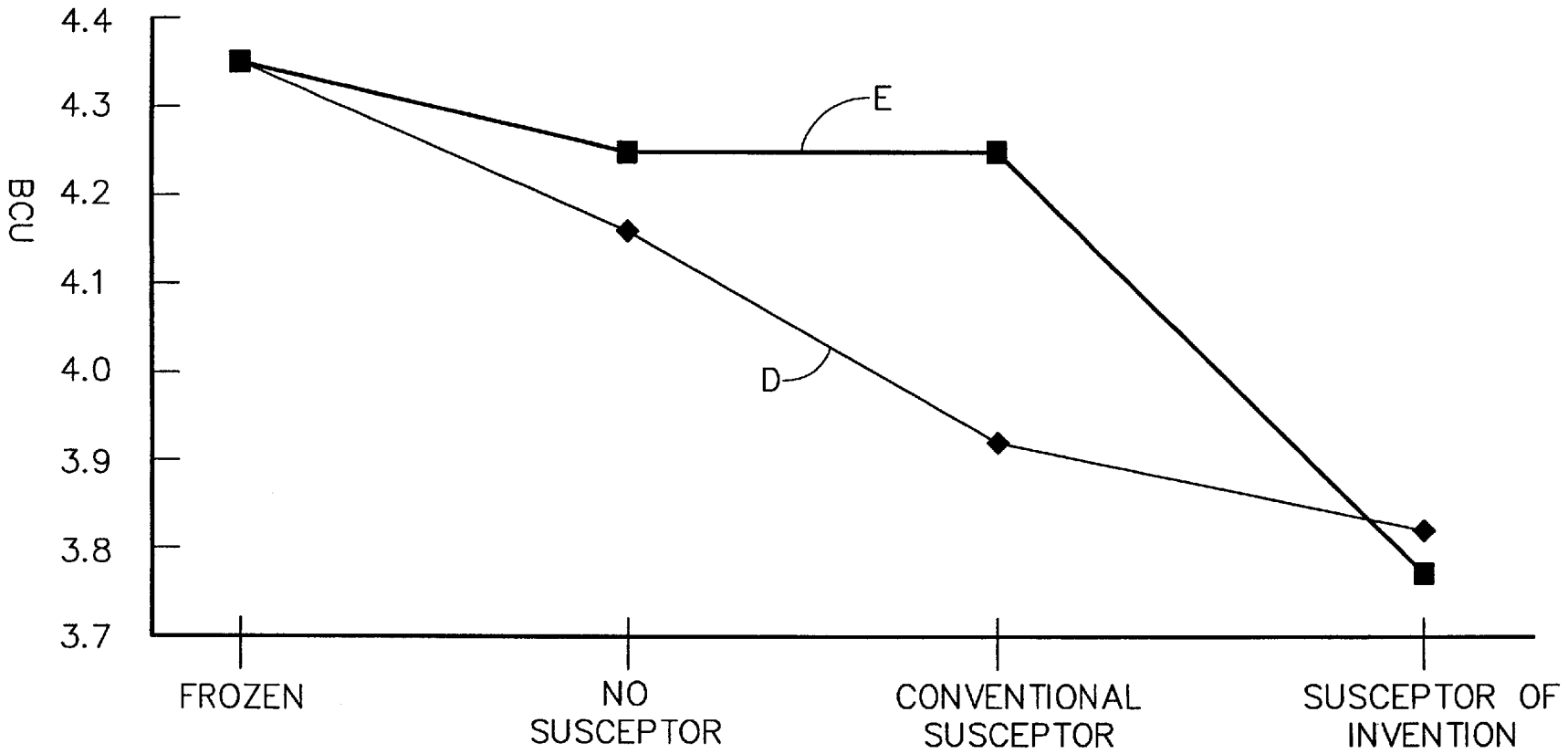
FIG. 4 is a graph showing the degree of browning achieved using the susceptor shown in FIG. 1 compared to the degree of browning achieved using no susceptor and a conventional susceptor.

The degree of browning of the crust of similarly heated pizza was measured using a Minolta™ BC-10 bake meter, which measures baking contrast units (BCU). The lower the BCU, the browner the color. Measurements were taken at eight locations along a first diameter of the pizza and at eight other locations along a second diameter perpendicular to the first diameter. The results are shown in FIG. 4 for frozen pizzas heated using the susceptor shown in FIG. 1, a comparable conventional susceptor, and no susceptor, compared to the frozen pizza before being heated. Line D represents the average BCU's recorded by the bake meter at all sixteen locations and line E represents the average BCU's recorded by the bake meter at the ten locations closest to the center of the pizza. As can be seen from FIG. 4, pizza heated using the susceptor of this invention produces pizza that is browner overall than pizza heated using a conventional susceptor, and that is especially browner at the central area of pizza.

We claim:

1. In an imperforate microwave susceptor comprising a layer of metallized plastic film laminated to a dimensionally stable substrate, the improvement wherein the susceptor has a pattern of substantially transparent circles in the layer of metal on the plastic film that enhances the heating effect of the susceptor in the central area of the susceptor, with each circle having a diameter of about 1.3 cm, the distance between adjacent circles being between about one and three cm, and the susceptor being electrically continuous.

2. The improvement of claim 1, wherein the proportion of the cumulative area of the transparent circles in the central area of the susceptor to the total area of the central area of the susceptor is from about 10 to 20%, and the central area of the susceptor having an area of about 80 sq. cm.

3. A microwave susceptor comprising:

a dimensionally stable substrate; and a generally continuous layer of metallized plastic film laminated to the substrate to form a microwave susceptor, the film having spaced-apart microwave-transparent areas within one generally continuous microwave-interactive area for enhancing the heating effect of the susceptor, each of the transparent areas having a major linear dimension of about one eighth an operating wavelength of a microwave oven.

4. The microwave susceptor of claim 3, wherein each of the transparent areas has a major linear dimension of about 1.3 cm.

5. The microwave susceptor of claim 3, wherein each transparent area has a width to height ratio between about 1 to 1 and about 2 to 1.

6. The microwave susceptor of claim 3, wherein each transparent area has a generally circular shape.

7. The microwave susceptor of claim 3, wherein adjacent transparent areas are separated by between about 1 and 3 cm.

8. The microwave susceptor of claim 3, wherein the susceptor is electrically continuous.

9. The microwave susceptor of claim 3, wherein the dimensionally stable substrate is paper or paperboard.

10. The microwave susceptor of claim 3, wherein the susceptor has a center portion surrounded by an outer portion, and wherein the center portion of the susceptor is at least 10 cm from a nearest edge of the susceptor.

11. The microwave susceptor of claim 10, wherein a cumulative area of the microwave-transparent areas disposed within the center portion is about 10% to 20% of a total area of the center portion.

12. The microwave susceptor of claim 3, wherein a cumulative area of the microwave transparent areas is about 7% to 15% a total area of the susceptor.

13. The microwave susceptor of claim 3, wherein the susceptor includes a peripheral margin portion having a microwave-transparent grid pattern.

14. The microwave susceptor of claim 3, wherein the transparent areas become more concentrated toward a center region of the susceptor.

* * * * *